United States Patent [19]

Barnard

[11] Patent Number: 4,810,443

[45] Date of Patent: Mar. 7, 1989

[54] METHOD FOR FORMING FILAMENTS FROM A RESIN

[75] Inventor: Thomas D. Barnard, Midland, Mich.

[73] Assignee: Dow Corning Coporation, Midland, Mich.

[21] Appl. No.: 69,098

[22] Filed: Jul. 2, 1987

[51] Int. Cl.[4] ..... B29C 47/76; B29B 13/06

[52] U.S. Cl. ..... 264/85; 264/29.1; 264/56; 264/177.13; 264/101; 528/12

[58] Field of Search ..... 264/29.5, 85, 29.1, 264/56, 177.13, 101; 528/12

[56] References Cited

U.S. PATENT DOCUMENTS

| | | | |
|---|---|---|---|
| Re. 31,447 | 11/1983 | Baney et al. | 264/65 |
| 2,955,320 | 10/1960 | Palmer et al. | 264/211.22 |
| 3,480,997 | 12/1969 | List | 425/14 |
| 4,298,559 | 11/1981 | Baney et al. | 264/65 |
| 4,310,481 | 1/1982 | Baney | 264/65 |
| 4,310,651 | 1/1982 | Baney et al. | 528/21 |
| 4,312,970 | 1/1982 | Gaul, Jr. | 526/279 |
| 4,314,956 | 2/1982 | Baney et al. | 264/65 |
| 4,340,619 | 7/1982 | Gaul, Jr. | 264/29.5 X |
| 4,395,460 | 7/1983 | Gaul | 264/29.5 X |
| 4,397,828 | 8/1983 | Seyferth et al. | 423/344 |
| 4,404,153 | 9/1983 | Gaul, Jr. | 264/29.2 |
| 4,482,669 | 11/1984 | Seyferth et al. | 524/442 |
| 4,482,689 | 11/1984 | Haluska | 528/25 |
| 4,535,007 | 8/1985 | Cannady | 427/226 |
| 4,540,803 | 9/1985 | Cannady | 556/412 |
| 4,543,344 | 9/1985 | Cannady | 501/92 |

*Primary Examiner*—Philip Anderson

*Attorney, Agent, or Firm*—Marshall, O'Toole, Gerstein, Murray & Bicknell

[57] ABSTRACT

A solution of resinous organosilicon polymer dissolved in an inert solvent is moved downstream as a film through a heated, film-forming zone having an inert atmosphere and a temperature above the polymer's melting point. The solvent is vaporized from the film and withdrawn from the film-forming zone. Molten resinous organosilicon polymer in the solvent-depleted film is withdrawn from the zone. The molten polymer is then directly melt spun into filaments which are gathered into a fiber. Various processing parameters are controlled.

15 Claims, 1 Drawing Sheet

METHOD FOR FORMING FILAMENTS FROM A RESIN

BACKGROUND OF THE INVENTION

The present invention relates generally to methods for forming filaments from a resin and more particularly to methods for processing a resinous organosilicon polymer to prepare it for melt spinning into a filament.

Certain resinous organosilicon polymers are useful as precursors for forming ceramic fibers having a composition consisting essentially of silicon and at least one of nitrogen and carbon. These ceramic fibers are useful, for example, in composite, high temperature-resistant materials, e.g., materials made into jet engine parts.

The resinous organosilicon polymer typically contains silicon, hydrogen, nitrogen and carbon, with oxygen present as an impurity. It may also contain certain additives, such as chlorine, boron, titanium or aluminum. This resin is typically processed into a fiber by melting solid resin and then melt spinning the molten resin in a conventional spinning device called a spinnerette, to form one or more filaments which are gathered into a fiber, and the fiber is wound around a spool or reel. The fiber is subjected to a cure process following which the cured fiber is subjected to a pyrolyzing operation which typically drives off the hydrogen and some of the nitrogen, silicon, carbon and oxygen as gas or vapor, to produce the ceramic fiber.

A more detailed description of a process for forming a ceramic fiber from a resinous organosilicon polymer is contained in an article by LeGrow et al., "Ceramics From Hydridopolysilazane", *Am.Ceram.Soc.Bull.*, 66[2]: 363–67 (1987), and the disclosure thereof is incorporated herein by reference.

A procedure which has been utilized for producing a molten resinous organosilicon polymer prior to melt spinning is to take solid resinous organosilicon polymer, the form in which that polymer is usually provided by the manufacturer thereof, break or crush the solid polymer into smaller pieces, and feed the smaller polymer pieces to a heated, screw type extruder, the output from which serves as the feed material to the melt spinning operation.

An alternative procedure involves compacting the smaller polymer pieces into a solid rod, typically employing pressure and elevated temperature and then mechanically forcing the solid rod against a heated plate to form molten polymer for melt spinning.

In a further alternative procedure, heat is applied to the polymer in a closed container to effect melting. The container of molten polymer then serves as a reservoir of feed material for the spinning operation.

The above-described procedures have been employed successfully in connection with organic polymers subjected to melt spinning, but they have several drawbacks when employed on resinous organosilicon polymers.

When resinous organosilicon polymer is at a temperature above its melting point for an extended period of time there is a danger that it will undergo heat degradation causing a loss of properties which are desirable in the subsequent processing and end uses. The danger of heat degradation is present when molten resinous organosilicon polymers are prepared employing the procedures described in the preceding paragraph. In addition, those procedures can cause undesirable air entrainment in the resinous organosilicon polymer or otherwise contaminate it which eventually results in poor physical properties in the ceramic fiber made from the resinous organosilicon polymer.

SUMMARY OF THE INVENTION

The drawbacks and disadvantages of the procedures described above are overcome by a method in accordance with the present invention. This method comprises preparing a solution of the resinous organosilicon polymer in an inert solvent, introducing the solution into an enclosed, heated, film-forming zone having upstream and downstream ends and directing the solution downstream through the film-forming zone to form a film from the solution. The film is heated to a temperature above the melting point of the resinous organosilicon polymer to form molten resinous organosilicon polymer in the film. The solvent is vaporized to reduce the solvent content of the film as it moves downstream, and the solvent vapor is withdrawn from the film-forming zone.

As the film moves in a downstream direction and solvent vapor is withdrawn, the concentration of the molten polymer in the film increases. Molten polymer is withdrawn from the film forming zone downstream of the location where the solution was introduced, and the withdrawn molten polymer is then subjected to melt spinning. Control is exercised over certain processing parameters, such as temperature, pressure and atmosphere within the film-forming zone. The resinous organosilicon polymer starting material embodies certain characteristics, described below.

A particular advantage of the present method arises from the fact that, in the course of manufacturing the resinous organosilicon polymer starting material used in the present invention, the manufacturer employs a film-forming method of the type described above. A similar method has been employed in the manufacture of certain organic polymers. However, in the case of both organic polymers and resinous organosilicon polymers, the molten polymer withdrawn from the film-forming zone in that manufacturing procedure was normally solidified and then, as noted above, broken up into pieces, remelted and extruded as a conventional preliminary procedure to melt spinning.

The resinous organosilicon polymer employed in the present invention is relatively easy to handle in the molten condition, in contrast to many organic polymers. Therefore, in accordance with the present invention, the steps of solidifying, breaking, etc., can be eliminated, and the molten polymer withdrawn from the film-forming zone employed in the manufacture of the resinous organosilicon polymer can be subjected to melt spinning directly. By placing the melt spinning operation in close proximity to the film-forming procedure employed in the manufacture of the resinous organosilicon polymer, it becomes unnecessary to solidify the molten polymer withdrawn from that film-forming procedure, in turn eliminating the need to break up the solid polymer, extrude it and remelt it. Locating the melt spinning operation in close proximity to the location where the film-forming procedure is performed and eliminating the extruding and remelting steps avoids maintaining the resinous organosilicon polymer at a temperature above its melting point for lengthy periods of time, thereby avoiding the danger of heat degradation of the polymer. Air entrainment or other contamination is minimized.

The present method may also be employed separate and apart from the manufacturing procedure for the resinous organosilicon polymer starting material. One need merely provide the aforementioned solution as the starting material. The important consideration in such a case is that one eliminates the extrusion procedure, or the alternative procedures, and their accompanying drawbacks, described above.

Furthermore, it is relatively easy and convenient to filter the polymer solution, just before the film-forming step, using conventional filter media of a variety of types. This filtration, in conjunction with the film-forming step, which separates volatiles from the polymer, serves to remove, just prior to melt spinning, the two major sources of contamination which are detrimental to the fiber-forming operation and to the properties of the resulting fiber.

Other features and advantages are inherent in the method claimed and disclosed or will become apparent to those skilled in the art from the following detailed description in conjunction with the accompanying diagrammatic drawings.

DETAILED DESCRIPTION

Figure 1:
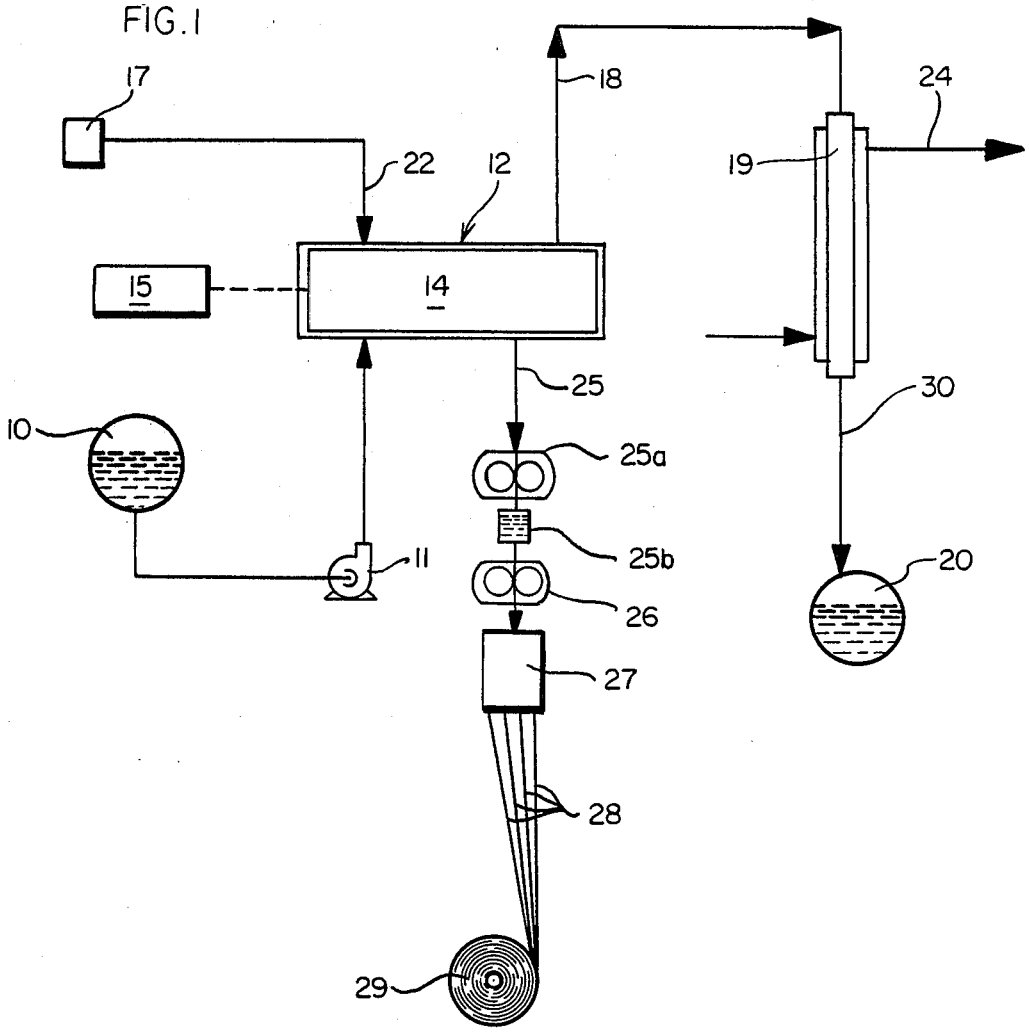
FIG. 1 is a flow diagram illustrating an embodiment of a method in accordance with the present invention.
Figure 2:
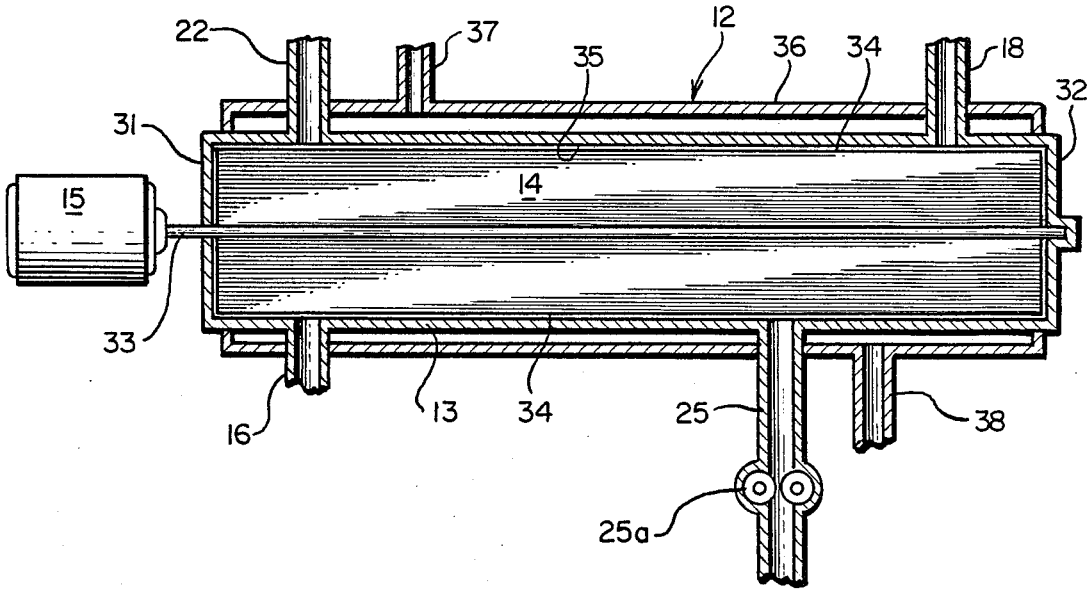
FIG. 2 is a sectional view illustrating an apparatus in which one embodiment of the film-forming procedure may be performed.

Referring initially to FIG. 1, indicated generally at 12 is an enclosed film-forming zone which may be in the form of a thin film evaporator illustrated in greater detail in FIG. 2. Thin film evaporator 12 comprises an outer cylinder 13 within which is located a coaxial, rotary blade 14 driven by a motor 15.

A solution composed of resinous organosilicon polymer dissolved in an inert solvent is contained in a feed tank 10. The solution is fed into film-forming zone 12 through a line 16 by a pump 11. Introduced into film-forming zone 12 through a line 22 and a metering device (not shown) is an inert gas such as nitrogen from an inert gas source 17. Alternatively, the polymer solution may be introduced into the film-forming zone by inert gas pressure and the use of a metering device.

The interior of film-forming zone 12 is heated to a temperature above the melting point of the resinous organosilicon polymer. The solution is directed downstream of the film-forming zone (to the right in FIG. 1), and as blade 14 rotates within cylinder 13, a film is formed along the interior surface of cylinder 13. The temperature within film-forming zone 12 is high enough to vaporize the solvent in the film, thereby to reduce the solvent content of the film as the film moves downstream. Solvent vapor is withdrawn from film-forming zone 12 through a line 18 leading to the interior of a condenser 19 from which liquid solvent is withdrawn through a line 30 into a liquid solvent receiver 20. A cooling fluid is circulated around the outside of condenser 19 via an inlet line 23 and an outlet line 24.

The temperature in film-forming zone 12 exceeds the melting point of the resinous organosilicon polymer contained in the solution so that molten resinous organosilicon polymer forms in the film. As the film moves in a downstream direction and the slvent is vaporized from the film, there is an increase in the concentration of the molten polymer in the film. Molten polymer is withdrawn from film-forming zone 12 through an outlet line 25 located downstream of the location where the solution is introduced into the film-forming zone through line 16.

The molten polymer withdrawn from film-forming zone 12 through line 25 passes through a discharge pump **25*a* and a level viewing chamber or viewing glass 25*b* and is then fed by a metering pump 26 into a melt spinner or spinnerette 27 which forms the molten resin into a multiplicity of filaments 28 which are gathered into a fiber wound around a spool 29. Spinnerette 27** is a commercially available, conventional device which is commonly preceded by a filtration pack (not shown).

Referring now to FIG. 2, there is illustrated in more detail an embodiment of a film-forming zone 12 in the form of a thin film evaporator. Cylinder 13 has upstream and downstream ends 31, 32 respectively. Extending from motor 15 is a shaft 33 rotatably supported at end walls 31, 32. Extending radially from shaft 33 are blades 14 terminating at distal edges 34, 34 located a very short distance away from the interior surface 35 of cylinder 13. Surrounding cylinder 13 on the outside is a heat jacket 36 through which a heating fluid is circulated via an inlet line 37 and an outlet line 38. As an alternative to heating jacket 36, cylinder 13 may be heated with electrical heating elements.

Motor 15 rotates shaft 33 which rotates blades 14 within cylinder 13. When solution is inside cylinder 13, rotation of blades 14 forms along interior surface 35 a thin film of solution having a thickness corresponding to the distance between distal blade edge 34 and the interior surface 35 of cylinder 13. As an alternative to the thin film evaporator or stripper described above, one may employ a flexible blade configuration in which the flexible blade wipes interior surface 35. Equipment employing such a blade configuration is commonly referred to as a wiped film evaporator. Both types of equipment described in this paragraph are readily available commercially.

As noted above, the atmosphere within film-forming zone 12 is inert, preferably nitrogen. Other inert atmospheres may be employed, including argon. In lieu of an inert atmosphere, a vacuum may be employed.

The temperature and pressure within the film-forming zone are controlled to promote vaporization of the solvent from the film in the film-forming zone and to form molten resinous organosilicon polymer from the solvent-depleted film. Typically, the pressure within film-forming zone 12 is in the range 10–760 mm Hg, and the temperature in zone 12 is in the range of about 150°–300° C. The temperature within the film-forming zone will vary with the composition of the resinous organosilicon polymer, and the pressure within zone 12 can vary in accordance with the solvent employed in the solution and may be higher or lower than the pressure range described in the previous sentence, including pressures greater than atmospheric.

In addition to being above the melting point of the resinous organosilicon polymer, the temperature in zone 12 must be below the temperature at which the molten polymer decomposes, but the temperature must also be high enough to impart to the molten polymer sufficient flowability to form a film of molten polymer in zone 12 and high enough to impart to the molten polymer withdrawn from zone 12 a viscosity sufficiently low to permit melt spinning of the molten polymer.

Examples of resinous organosilicon polymer which may be employed include hydridopolysilazanes (HPZ) and methylpolydisilylazanes (MPDZ). The MPDZ may be phenylvinyl modified. Additional information on HPZ, its composition prepration and properties is contained in said LeGrow et al. publication identified above under the subheading "Background of the Invention" and in Cannady U.S. Pat. No. 4,540,803, the disclosures of which are incorporated herein by reference. Similar information on MPDZ is contained in Gaul U.S. Pat. No. 4,340,619, the disclosure of which is incorporated herein by reference.

Other resinous organosilicon polymers useful as precursors for forming ceramic fibers may also be employed in the method of the present invention, and some of these other polymers are identified below together with the patents describing them.

Baney et al. U.S. Pat. No. 4,310,651 (issued Jan. 12, 1982) discloses a polysilane of general formula $(CH_3Si)((CH_3)_2Si)$ where there is present 0 to 60 mole percent $((CH_3)_2Si)$ units and 40 to 100 mole percent $(CH_3Si)$ units and where the remaining bonds on silicon are attached to other silicon atoms and chlorine atoms or bromine atoms. The polysilanes of U.S. Pat. No. 4,310,651 generally are difficult to handle due to their high reactivity in air.

Baney et al. U.S. Pat. No. 4,298,559 (issued Nov. 3, 1981) discloses polysilanes of general formula $(CH_3Si)((CH_3)_2Si)$ where there is present 0 to 60 mole percent $((CH_3)_2Si)$ units and 40 to 100 mole percent $(CH_3Si)$ units and where the remaining bonds on silicon are attached to other silicon atoms and additional alkyl radicals of 1 to 4 carbon atoms or phenyl radicals.

Baney U.S. Pat. No. 4,310,481 (issued Jan. 12, 1982) discloses polysilanes of the general formula $(CH_3Si)((CH_3)_2Si)$ where there is present 0 to 60 mole percent $((CH_3)_2Si)$ units and 40 to 100 mole percent $(CH_3Si)$ units and where the remaining bonds on silicon are attached to silicon and $(CH_3)_3SiO$-radicals.

Baney U.S. Pat. No. 4,310,482 (issued Jan. 12, 1982) discloses polysilanes of the general formula $(CH_3Si)((CH_3)_2Si)$ where there is present 0 to 60 mole percent $((CH_3)_2Si)$ units and 40 to 100 mole percent $(CH_3Si)$ units and where the remaining bonds on silicon are attached to silicon and hydrogen.

Baney et al. U.S. Pat. No. 4,314,956 (issued Feb. 9, 1982) discloses polysilanes of the general formula $(CH_3Si)((CH_3)_2Si)$ where there is present 0 to 60 mole percent $((CH_3)_2Si)$ units and 40 to 100 mole percent $(CH_3Si)$ units and where the remaining bonds on silicon are attached to silicon and amine radicals of the general formula —NHR" where R" is a hydrogen atom, an alkyl radical of 1 to 4 carbon atoms or a phenyl radical.

Baney et al. U.S. Pat. No. Re. 31,447 (reissued Nov. 22, 1983) discloses polysilanes of the general formula $(CH_3Si)((CH_3)_2Si)$ where there is present 0 to 60 mole percent $((CH_3)_2Si)$ units and 40 to 100 mole percent $(CH_3Si)$ units and where the remaining bonds on silicon are attached to other silicon atoms and alkoxy radicals containing 1 to 4 carbon atoms or phenoxy radicals.

Gaul U.S. Pat. No. 4,312,90 (issued Jan. 26, 1982) discloses polysilazane polymers synthesized by reacting various alkyltrichlorosilanes with a disilazane, such as $[(CH_3)_3Si]_2NH$. In this synthesis, $(CH_3)_3SiCl$ is eliminated as a by-product.

Gaul U.S. Pat. No. 4,404,153 (issued July 20, 1982) discloses silazane polymers, which polymers were prepared by reacting chlorine-containing disilanes and disilazanes.

Cannady U.S. Pat. No. 4,543,344 (issued Sept. 24, 1985) discloses polymers prepared by reacting $HSiCl_3$ and disilazanes.

Cannady U.S. Pat. No. 4,540,803 (issued Sept. 10, 1985), discussed above in connection with HPZ, describes a modification to the process of Gaul U.S. Pat. No. 4,404,153 directed to the preparation of a polyhydridomethylsilazane polymer from trichlorosilane and hexamethyldisilazane.

Additional relevent polymers are disclosed in Gaul U.S. Pat. No. 4,395,460, issued July 26, 1983; Gaul U.S. Pat. No. 4,404,153, issued Sept. 13, 1983; Haluska U.S. Pat. No. 4,482,689, issued Nov. 13, 1984; Seyferth et al. U.S. Pat. No. 4,397,828, issued Aug. 9, 1983; Seyferth et al. U.S. Pat. No. 4,482,669, issued Nov. 13, 1984; and Cannady U.S. Pat. No. 4,535,007, issued Aug. 13, 1985.

The disclosures in the above-identified U.S. Patents are incorporated herein by reference.

The method of the present invention is also useful with other, similar preceramic polymers which do not contain silicon. For example, polymers which are convertible to boron nitride ceramics may also be advantageously processed by the method of this invention. All that is required is that the polymer be soluble in a suitable solvent, and the processing of that polymer with the method of the present invention would be the equivalent of processing organosilicon polymers with the same method.

Referring again to the HPZ and MPDZ-type polymers, when the polymer is a HPZ-type, a temperature in the range 150°–250° C. may be employed within film-forming zone 12. When an MPDZ-type is the polymer, a temperature in the range 175°–275° C. may be employed within film-forming zone 12. Temperatures within the ranges described above would be above the melting point of the resinous organosilicon polymer and would impart to the polymer the desired viscosity, e.g. 100 poise. These resinous organosilicon polymers are relatively easy to handle in the molten condition.

The solvent employed with the resinous organosilicon polymer shoud be inert so that it does not react with the polymer and should be vaporizable at the temperature and pressure conditions existing within the film-forming zone. The lower the pressure, the lower the temperature needed to vapòrize the solvent. Examples of solvents which may be employed for the polymers described above include heptane, toluene and xylene. Different kinds of solvents may be employed so long as they have the properties described above.

The resinous organosilion polymer employed must, of course, be soluble in a vaporizable solvent.

The film formed within film-forming zone 12 typically has a thickness in the range 0.8 to 3.2 mm, preferably about 1.6 mm.

In lieu of a film-forming zone of the type employing a rotary blade (FIG. 2), other types of film-forming equipment may be employed, e.g. a falling film evaporator. The important design considerations are that the solution be depleted of solvent as it moves in a downstream direction through the film-forming zone and that molten polymer be produced for withdrawal at the downstream end of the film-forming zone.

By employing a film-forming procedure to produce molten resinous organosilicon polymer and feeding the molten polymer withdrawn from the film-forming zone directly to the melt spinning operation, there is a substantial reduction in the time during which the resinous organosilicon polymer is at a temperature above its melting point, thereby reducing the danger of heat degradation. By eliminating the steps of solidifying the resinous organosilicon polymer, crushing, extruding, and remelting there is a substantial reduction in the handling to which the polymer is subjected, thereby reducing the danger of contamination which can have an undesirable effect on the properties of the resinous organosilicon polymer and the ceramic fiber produced therefrom.

The following example further illustrates the present invention. Phenylvinyl-modified MPDZ polymer, prepared generally as described in Gaul, U.S. Pat. No. 4,340,619, was converted to spun fiber by the following process. The particular batch of polymer used in this example had a softening point of 93° C. as determined on a DuPont Thermal Mechanical Analyzer. The polymer, previously isolated in solid form from the polymer preparation process, was dissolved in toluene, under a nitrogen atmosphere, at a concentration of 30 wt. percent. This simulated a solution that would result directly from the polymer preparation process. This solution was then pumped by a diaphragm-type metering pump at a rate of approx. 12–22 cc/min. to a "Rototherm" thin-film stripper with 0.25 sq. ft. of heated, internal surface area. The outer barrel of the stripper was heated by means of electrical heating tapes to provide an internal temperature in the film-forming zone of approx. 250°–275° C. Nitrogen gas was supplied to the stripper at a slow rate (estimated to be 1 SCFM). Toluene vapor was withdrawn from the stripper at atmospheric pressure. Molten polymer was withdrawn from the stripper through a discharge pump and a line. The line was heated to about 180° C. by electric tracing to keep the polymer molten and flowable. The feed rate of the polymer solution was adjusted so as to maintain a visible level in the viewing glass. From there, the molten polymer flowed directly through electrically heated lines to a "Zenith" gear pump serving as the metering pump to a spinneret. The flow rate through this pump was varied between 5 and 9 cc/min., as dictated by the requirements of the spinning operation. The spinneret had 200 holes, each of 0.33 mm diameter. The metering pump was maintained at a temperature of 150° C., and the spinneret temperature was varied between 130° and 150° C., as needed, to maintain a stable spinline. The spun fiber was taken up on a reel for further processing.

The foregoing detailed description has been given for clearness of understanding only, and no unnecessary limitations should be understood therefrom, as modification will be obvious to those skilled in the art.

I claim:

1. A method for producing filaments from a resinous organosilicon polymer, said method comprising the steps of:

preparing a solution of said resinous organosilicon polymer in an inert solvent;

introducing said solution into an enclosed, heated, film-forming zone having upstream and downstream ends;

directing said solution downstream through said film-forming zone;

forming and maintaining a film from said solution as it moves downstream;

heating said film to a temperature above the melting point of said resinous organosilicon polymer to form molten resinous organosilicon polymer in the film;

vaporizing said solvent in said film to reduce the solvent content of the film as the film moves downstream;

withdrawing the solvent vapor from said film-forming zone;

increasing the concentration of said molten polymer in the film as the film moves in a downstream direction and said solvent vapor is withdrawn;

withdrawing said molten polymer from said film-forming zone downstream of the location where said solution was introduced;

and then directly melt spinning said molten polymer withdrawn from the film forming zone.

2. A method as recited in claim 1 wherein:

said enclosed, film-forming zone has an inert atmosphere.

3. A method as recited in claim 2 wherein:

said inert atmosphere is nitrogen.

4. A method as recited in claim 1 wherein:

the pressure within said enclosed, film-forming zone is in the range 10–760 mm Hg.

5. A method as recited in claim 1 wherein:

the temperature within said film-forming zone is above the melting point of said polymer and below the temperature at which said molten polymer decomposes.

6. A method as recited in claim 5 wherein:

said temperature is high enough to impart to said molten polymer sufficient flowability to form a film of said molten polymer in said zone;

and said method comprises forming a film composed substantially of said molten polymer at least adjacent the downstream end of said film-forming zone.

7. A method as recited in claim 6 wherein:

the temperature of the molten polymer withdrawn from said film-forming zone is high enough to impart to said withdrawn molten polymer a viscosity sufficiently low to permit melt spinning of the molten polymer.

8. A method as recited in claim 6 wherein:

said temperature in the film-forming zone is in the range of about 150°–300° C.

9. A method as recited in claim 1 wherein:

the temperature within said film-forming zone is in the range of about 150°–300° C.;

and the pressure in said zone is in the range 10–760 mm Hg.

10. A method as recited in claim 9 wherein:

said inert solvent vaporizes at the temperature and pressure conditions existing within said zone.

11. A method as recited in claim 1 wherein:

said film-forming zone comprises a cylinder within which rotates a coaxial blade forming a thin film along the inner surface of the cylinder;

said film having a thickness in the range of about 0.8 to 3.2 mm.

12. A method as recited in claim 1 wherein:

said resinous organosilicon polymer is a precursor to a ceramic material consisting essentially of silicon and at least one of nitrogen and carbon.

13. A method as recited in claim 1 wherein:

said method constitutes part of the manufacturing procedure for said resinous organosilicon polymer;

and the location of said melt spinning step is in close proximity to the location where the preceding steps in said method are performed.

14. A method as recited in claim 13 wherein:

the molten polymer withdrawn from said film-forming zone is subjected to melt spinning without any intervening solidifying step.

15. A method as recited in claim 1 and comprising:

filtering said solution before said introducing step.

* * * * *